US005692799A

United States Patent [19]

Sheets

[11] Patent Number: 5,692,799

[45] Date of Patent: Dec. 2, 1997

[54] CONVERTIBLE TABLE OR BENCH

[76] Inventor: Raymond Sheets, 46336 Seville La., East Liverpool, Ohio 43920

[21] Appl. No.: 652,150

[22] Filed: May 23, 1996

[51] Int. Cl.[6] ..... A47B 85/04

[52] U.S. Cl. ..... 297/124; 297/174; 108/12

[58] Field of Search ..... 297/124, 174, 297/172, 158.5; 108/1, 6, 12, 50, 62

[56] References Cited

U.S. PATENT DOCUMENTS

| | | | |
|---|---|---|---|
| 1,401,083 | 12/1921 | Jurkovich | 297/124 |
| 1,757,960 | 5/1930 | Greenstreet . | |
| 1,792,737 | 2/1931 | Greenstreet . | |
| 2,481,935 | 9/1949 | Larson | 297/124 |
| 2,486,468 | 11/1949 | Freedman | 297/124 X |
| 2,506,606 | 5/1950 | McCaw | 297/124 |
| 2,561,703 | 7/1951 | Koenig . | |
| 2,645,273 | 7/1953 | Culbertson et al. . | |
| 2,745,466 | 5/1956 | Thompson . | |
| 2,758,633 | 8/1956 | Apple | 297/124 |
| 2,842,185 | 7/1958 | Fortine | 297/124 |
| 2,856,985 | 10/1958 | Lepper | 297/124 |
| 2,882,957 | 4/1959 | Anderson | 297/124 |
| 2,897,876 | 8/1959 | Austin | 297/124 X |
| 2,922,463 | 1/1960 | Johnston | 297/124 |
| 2,931,425 | 4/1960 | Rasco et al. | 297/124 |
| 2,959,209 | 11/1960 | Lakin | 297/124 |
| 3,061,369 | 10/1962 | Haunost | 297/124 |
| 3,361,470 | 1/1968 | Gustin et al. | 297/124 |
| 3,367,712 | 2/1968 | Greene | 297/124 |
| 3,420,571 | 1/1969 | Moore | 297/124 |
| 3,592,506 | 7/1971 | Breslow . | |
| 3,650,351 | 3/1972 | Schmidt . | |
| 4,194,784 | 3/1980 | Dostal et al. . | |
| 4,606,575 | 8/1986 | Kodet | 297/124 |
| 4,615,559 | 10/1986 | Blondeau | 297/124 |
| 4,645,261 | 2/1987 | Bourne et al. . | |
| 4,647,107 | 3/1987 | Hoover et al. . | |
| 4,801,175 | 1/1989 | Albanese | 297/124 |
| 4,913,488 | 4/1990 | Donnell, Jr. | 297/124 |
| 4,921,302 | 5/1990 | Goodwin | 297/174 X |
| 5,011,228 | 4/1991 | Marcantel | 297/174 X |
| 5,398,990 | 3/1995 | Watts et al. . | |

*Primary Examiner*—Peter M. Cuomo
*Assistant Examiner*—Rodney B. White
*Attorney, Agent, or Firm*—Renner, Otto, Boisselle & Sklar, P.L.L.

[57] ABSTRACT

A novel bench/table assembly characterized by various features including, inter alia, a tab that is engageable with an L-shaped slot arrangement to position selectively a moveable member in either a seat backrest position or a tabletop position. The L-shaped slot and tab arrangement facilitating conversion from one configuration to another without the use of screws, bolts, dowel pins, notches or other securing devices. The bench/table assembly providing for furniture which is easily and quickly convertible between a bench and a table without the employment of tools or hardware. The L-shaped slots and tabs providing for a stronger and more stable piece of furniture. Safety stops prevent the moveable member from abruptly dislodging from the tabletop position to the seat backrest.

36 Claims, 13 Drawing Sheets

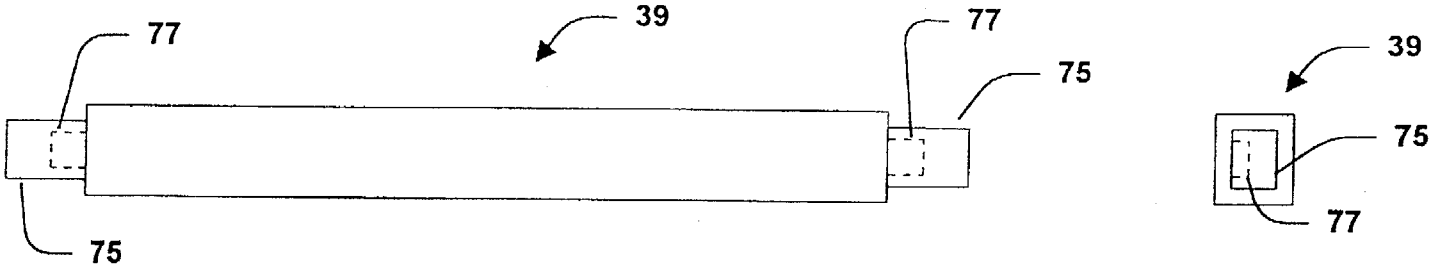
Fig. 6A
Fig. 6B
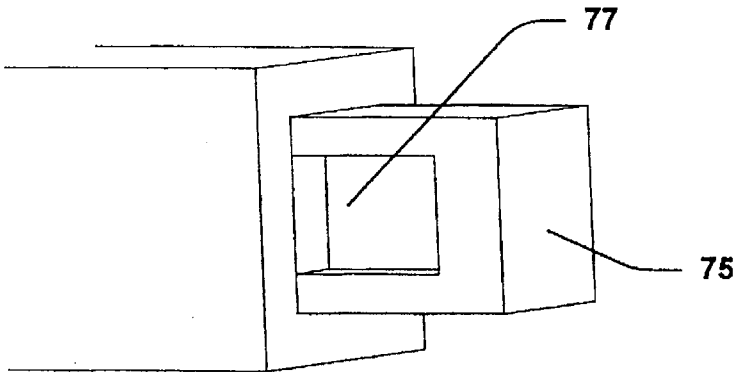
Fig. 6C
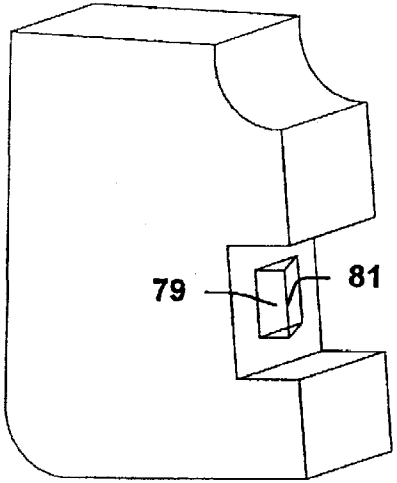
Fig. 6D

CONVERTIBLE TABLE OR BENCH

FIELD OF THE INVENTION

The present invention relates generally to a combination bench/table assembly wherein a common section of the assembly serves as either a bench back or a tabletop. More particularly, the invention relates to an improved construction of such bench/table assembly for positioning the common section in either a horizontal or tilted position.

BACKGROUND

Recreational furniture such as benches and picnic tables have been a source of enjoyment for many years. Benches have traditionally provided people with a place to sit and relax outside in the yard. Benches are often used to provide convenience and comfort for leisurely relaxation outdoors. Additionally, benches are oftentimes used to add to the aesthetic appearance of back yards and gardens.

Despite the convenience and comfort that the aforementioned benches provide, such benches are not very useful when it comes time to eat—no tabletop is available to place one's plate of food on. Thus, it is common for people to also have a picnic table in order to provide a place to comfortably eat. However, when a meal is completed, the picnic table does not serve as a very comfortable piece of furniture for purposes of relaxing and enjoying the outdoors.

Unfortunately, recreational space can be limited for many homeowners and consumers—having both a bench and a picnic table may be out of the question due to their relatively large size. Also, with rising consumer prices, it is not always possible for consumers to purchase multiple pieces of recreational furniture such as a bench and picnic table.

In view of the foregoing, numerous attempts have been made in the past to produce a convertible bench/table assembly which serves as both a bench and a picnic table. The bench/table assembly provides a bench with a seat in one configuration, and is convertible into a seat with a tabletop (analogous to a picnic table) in the other configuration. As part of the conversion, the portion serving as the backrest of the bench is repositioned from a generally vertical position to a horizontal position so as to serve as a tabletop. Although such conventional art bench/table assemblies afford marked advantages over individual benches and picnic tables, there are still many disadvantages associated with such bench/table assemblies.

For example, a primary reason conventional bench/table assemblies have not been commercially successful is that the stop mechanisms intended to maintain the tabletop in a horizontal position are inadequately designed. These conventional bench/table assemblies generally have been designed in such a manner that instability in the tabletop configuration results due to wear and tear even after relatively little usage. Alternatively, the design is so complicated that the bench/table assembly cannot be manufactured in a commercially feasible manner.

For example, the conventional bench/table assemblies typically employ complicated mechanical latches and multiple pivotal points to accomplish a conformational transformation of the bench into a picnic table for dining. Consequently, the components of the conventional bench/table assemblies rely upon multiple working parts, a great number of nut and bolt assemblies and an array of pivotal joints to construct the final working unit. Accordingly, production and manufacturing costs are proportionally increased as a result of the numerous mechanical parts; and these increased costs are ultimately borne by the consumers via a more expensive product.

Additionally, the multitude of parts in prior art assemblies usually present the consumer with a very lengthy and frustrating construction process. The complicated arrangement of the nut and bolt assemblies and the array of pivotal joints in the bench/table assembly can prove to be somewhat overwhelming to the consumer. In most situations, the consumer ends up attempting to read and decipher lengthy, complicated and sometimes unintelligible instructions to construct a working bench/table assembly.

Moreover, consumers generally desire a bench/table assembly with a simple and easy means of converting the seat backrest of the bench into the table configuration. Additionally, conventional bench/table assemblies often prove difficult in converting from the bench configuration to the tabletop configuration. In some instances, not only do pivotal pins have to be adjusted or frame members slidably modified in their adjacent slots, but with many known assemblies, the repositioning of the backrest into the tabletop requires more than one individual to accomplish the task.

Furthermore, conventional bench/table assemblies are often produced in smaller sizes for use as children's furniture. Unfortunately, the aforementioned multiple pivot points and many mechanical parts can pose a serious safety hazard for children. The multitude of pivot points increases the likelihood of a child getting a finger, toe or limb seriously injured. Additionally, as mentioned above, the prior art bench/table assemblies generally become or already are unstable in the tabletop configuration which could in turn expose a child to yet even more danger. It is known that children oftentimes are rough on furniture. Consequently, a bench/table assembly of greater strength and stability would be more desirable in furniture for children.

In light of the above-mentioned drawbacks, there is a strong need in the art for a convertible bench/table assembly that is aesthetically pleasing, durable, and is structurally stable in either the bench configuration or the tabletop configuration. Additionally, there is a strong need for a bench/table assembly having a design making it easy to manufacture and assemble with relatively few mechanical parts. Furthermore, there is a strong need for a bench/table assembly that is easy to convert between a bench configuration and a tabletop configuration. Moreover, there is a strong need for a bench/table assembly that overcomes the safety problems associated with previous assemblies.

SUMMARY OF THE INVENTION

The present invention provides a bench/table assembly characterized by various features including, inter alia, a tab that is engageable with an L-shaped slot arrangement to position selectively a moveable member in either a seat backrest position or a tabletop position. The L-shaped slot and tab arrangement facilitates conversion between a bench and a table without the use of screws, bolts, dowel pins, notches or other securing devices. Consequently, the bench/table assembly is easily and quickly convertible from a bench to a table and vice versa. Additionally, the bench/table assembly can be converted without the need for tools or hardware. Furthermore, the L-shaped slots and tabs provide for a much stronger and more stable piece of furniture than is commonly found. Also, the bench/table assembly of the present invention has safety stops to prevent the moveable backrest/tabletop from abruptly dislodging from the tabletop position to the backrest position. These safety stops along with the minimum amounts of moveable and mechanical parts afford for increased safety which is especially desirable in furniture for children. Moreover, the bench/table assembly of the present invention is versatile, simple, economical and aesthetically pleasing in design.

According to one aspect of the invention, a bench/table assembly is provided, including: two support members, each of the two support members including an L-shaped slot; a seat member spanning the two support members; and a substantially planar moveable member spanning the two support members, the moveable member including two extensions, each extension being disposed on opposite sides of the moveable member, the moveable member being positionable between a first position, exhibiting a seat backrest, and a second position exhibiting a tabletop, the positioning of the moveable member being effectuated by slidable engagement of the extensions with the L-shaped slots.

According to another aspect of the invention, a bench/table assembly is provided, including: two support members, each of the two support members including an L-shaped slot, and each of the two support members further including at least one safety stop; a seat member spanning the two support members; at least one structural brace spanning the two support members to provide support thereof; and a substantially planar moveable member spanning the two support members, the moveable member comprising two extensions, each extension being disposed on opposite sides of the moveable member, the moveable member being positionable between a first position, exhibiting a seat backrest, and a second position exhibiting a tabletop, the positioning of the moveable member being effectuated by slidable engagement of the extensions with the L-shaped slots, the moveable member being maintained in the first position by gravity, the moveable member being maintained in the second position by the at least one safety stop which prevents dislodging of the moveable member from the second position to the first position.

In accordance with yet another aspect of the invention, a bench/table assembly is provided, including: a seat member; means for structurally supporting the seat member including at least two support members, wherein each support member has an L-shaped slot and at least one safety stop, the means for structurally supporting the seat member including at least one support brace; a substantially planar moveable member, the moveable member including two extensions, each extension being disposed on opposite sides of the moveable member, the moveable member spanning the two support members; means for positioning the moveable member between a first position, exhibiting a seat backrest, and a second position exhibiting a tabletop, wherein the means for positioning the moveable member includes slidable engagement of the extensions with the L-shaped slots to effectuate the positioning of the moveable member; and means for securing the moveable member in the second position, wherein the means for securing the moveable member in the second position includes using at least one safety stop to securely wedge the moveable member and prevent the moveable member from dislodging from the second position to the first position.

To the accomplishment of the foregoing and related ends, the invention then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

FIG. 6A is a top view of a structural brace according to the invention.

FIG. 6B is an end view of the structural brace in FIG. 6A.

FIG. 6C is an enlarged perspective view of the brace protrusion and cavity of the structural brace in FIG. 6A.

FIG. 6D is an isometric view of section A—A of the support member in FIG. 4A illustrating a wedge, for securing a structural brace to the support member, according to the invention.

DETAILED DESCRIPTION

Figure 1:
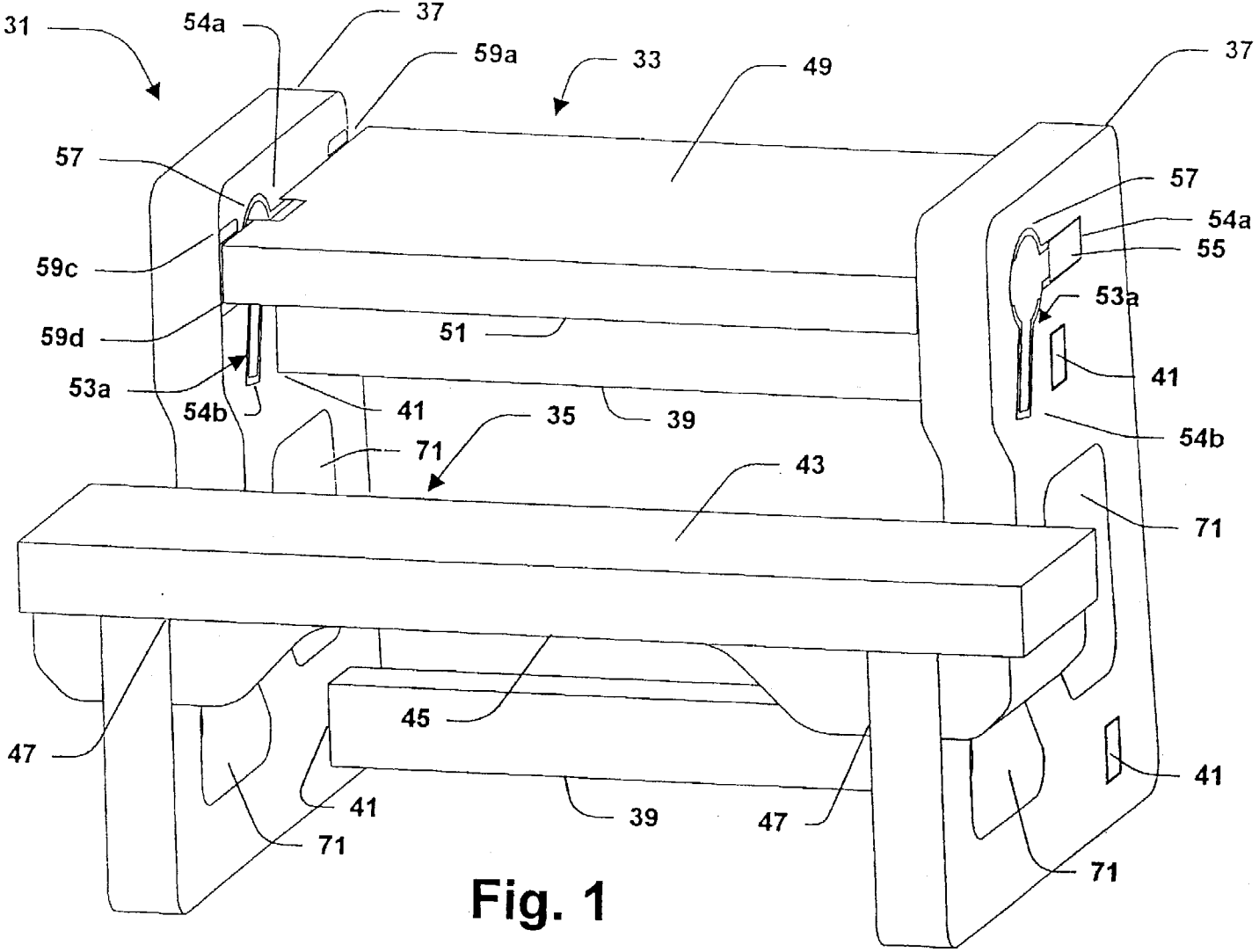
FIG. 1 is a perspective view of a bench/table assembly with a moveable member in a tabletop position according to the invention.

The present invention will now be described with reference to the drawings in which like reference numerals are used to refer to like elements throughout.

Referring initially to FIG. 1, a bench/table assembly according to the present invention is generally indicated by reference numeral 31. The bench/table assembly 31 is shown in a table configuration having, a moveable member 33, a seat member 35, two vertical support members 37, and two braces 39. The braces 39 extend horizontally between the two support members 37 and are secured to the support members 37 by interlocking engagement with slots 41 respectively disposed on the support members 37. The seat member 35 also extends horizontally between the two support members 37. The seat member 35 has a top portion 43 and bottom portion 45. The top portion 43 of the seat member 35 is substantially flat and is suitable for comfortable seating. However, it is understood that a number of other surface embodiments suitable for providing comfortable seating are within the scope of this invention, including, for example, slight curvature for added comfort. The seat member 35 is mounted to the two support members 37 via the two reliefs 47 located on the bottom portion 45 of the seat member 35. However, the seat member 35 may be mounted or positioned on the two support members 37 by other conventional means such as screws, friction fits, glue, etc. The moveable member 33 is of substantially planar design and has a substantially flat top surface 49 and a substantially flat bottom surface 51. The substantially flat surfaces 49 and 51 are conducive to dining, playing games, writing and drawing upon. Of course, other conventional tabletop configurations would be suitable as well.

The support members 37 include L-shaped slots 53*a* which afford for positioning of the moveable member 33 between a first position, serving as a seat backrest, and a second position, servings as a tabletop. The L-shaped slots 53*a* each have an upper leg 54*a* and a lower leg 54*b*. The positioning of the moveable member 33 is effectuated by slidable engagement of extensions 55 of the moveable member 33 with the L-shaped slots 53*a*. The L-shaped slots include an aperture 57 which in the preferred embodiment is of a substantially circular configuration. However, the aperture 57 may be of any shape suitable for allowing free rotation of the extension 55 therein. The support members 37 also include safety stops 59*a*–59*e* (collectively referred to as 59) (See FIG. 3). The safety stops 59*a*–59*d* serve to secure the moveable member 33 in the tabletop position. The safety stops 59*a*–59*d* ensure that the moveable member 33 will not inadvertently dislodge into the seat backrest position and possibly injure a user of the bench/table assembly 31. Additionally, either one or both of the support members 37 may include an armrest (not shown) to provide further comfort to a user of the assembly 31.

Figure 2:
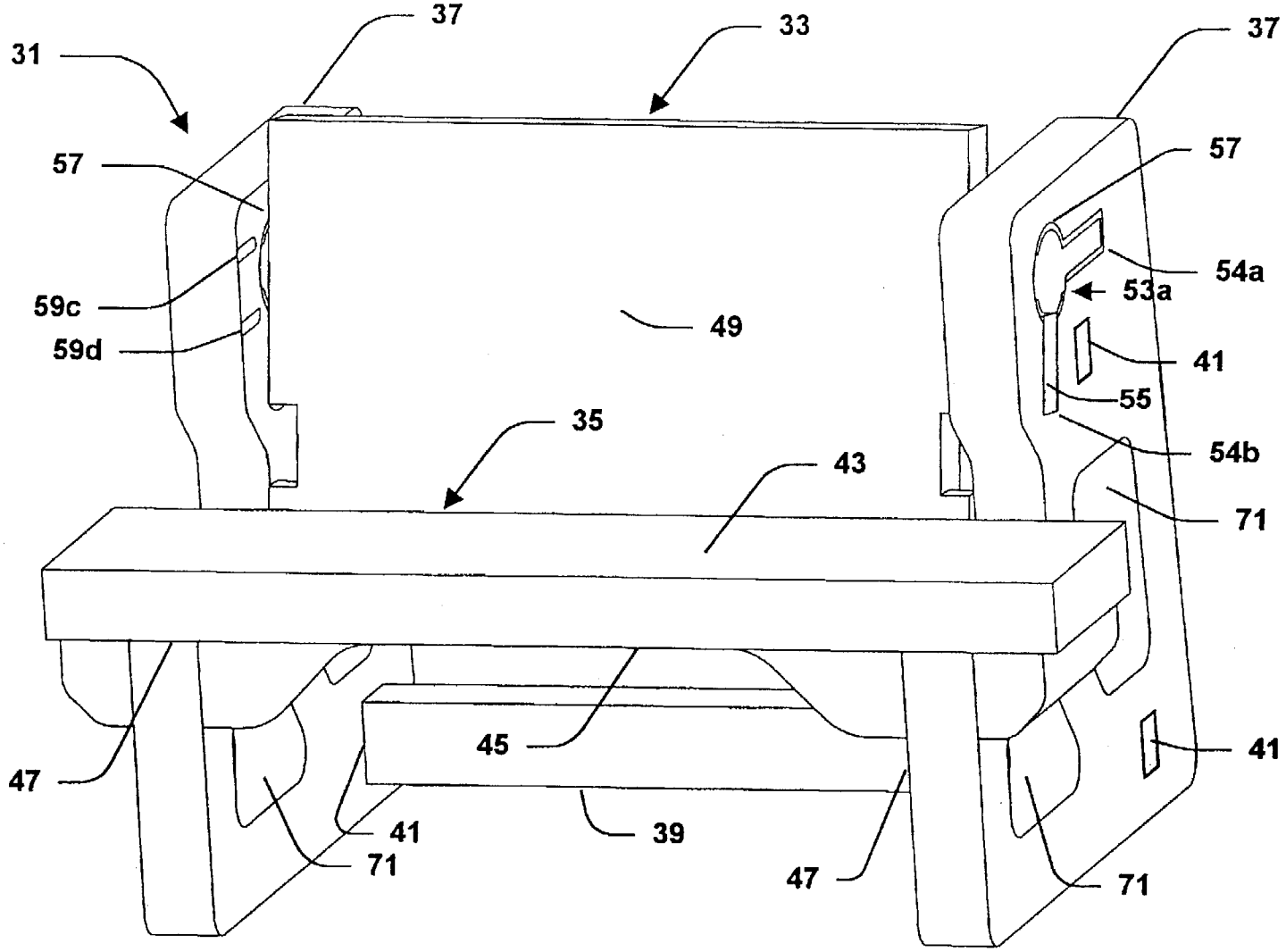
FIG. 2 is a perspective view of the bench/table assembly with a moveable member in a seat backrest position according to the invention.

Thus, in operation, the bench/table assembly 31 is convertible from a bench position to a tabletop position (analogous to a picnic table) by positioning the moveable member 33 between a seat backrest position which results in the assembly 31 being configured as a bench (as shown in FIG. 2) and a tabletop position, which results in the assembly 31 being configured as a table (as shown in FIG. 1).

The material composition of the bench/table assembly 31 is not critical to this invention. Accordingly, the assembly 31 may be of wood, plastic, metal, rubber, fiberglass, fibers or any combination of these materials or the like. In the exemplary embodiment, the bench/table assembly is made from heavy molded plastic which is strong, light weight, aesthetically pleasing, easy to manufacture from, and an easily affordable material.

Referring now to FIG. 2, the bench/table assembly 31 is illustrated in the bench configuration. The moveable member 33 is shown positioned in the seat backrest position to effect a bench that is suitable for comfortable seating.

Figure 3:
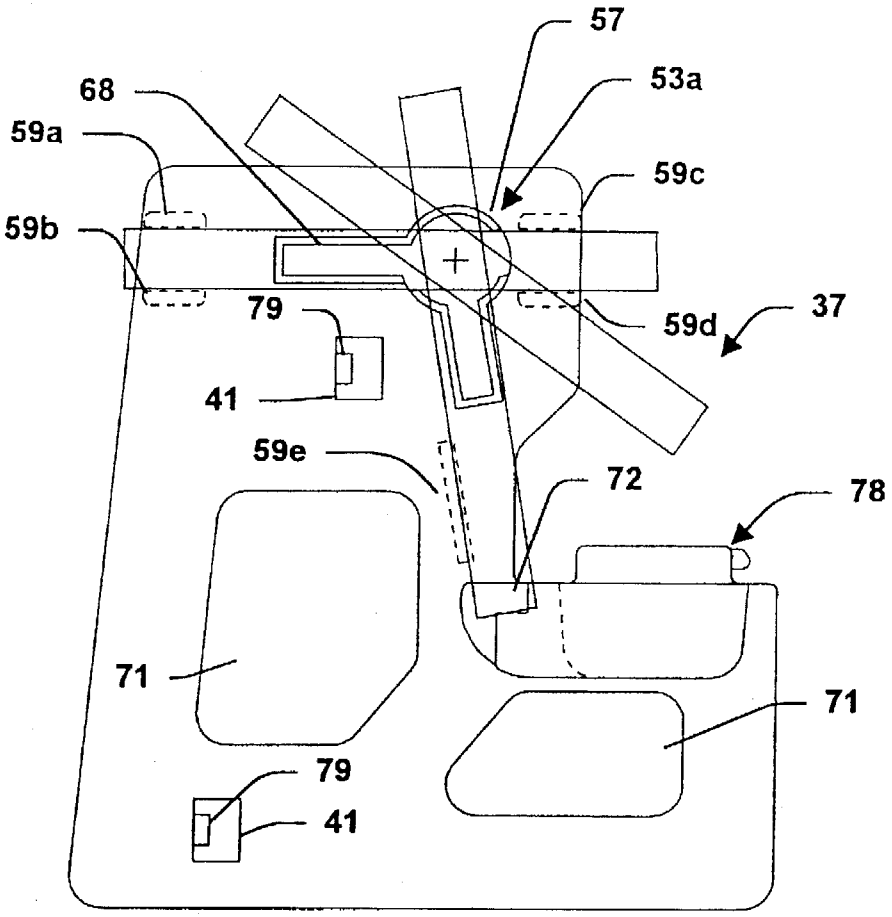
FIG. 3 is a side view of the bench/table assembly illustrating the transitioning of the moveable member between the tabletop position (shown in FIG. 1) and the seat backrest position (shown in FIG. 2) according to the invention.

FIG. 3 illustrates the positioning of the moveable member 33 between the tabletop position as shown in FIG. 1 and the seat backrest position shown in FIG. 2. When it is desired to position the moveable member 33, the extensions 55 provide a means to slide the moveable member between the seat backrest position and the tabletop position, while the appendages 67 (FIG. 5A) provide a means of keeping extensions 55 from disengaging from flange 68. For instance, when moving the member 33 from the tabletop position to the seat backrest position, the member 33 is slid laterally toward the front end of the assembly 31 until the extensions 55 become horizontally aligned with the approximate center of the aperture 57. At this point, the moveable member 33 will be freely rotatable, approximately 85 degrees along the horizontal axis of the aperture 57. The member 33 is then rotated until the extensions 55 become parallel with the lower legs 54*b* of the L-shaped slots 53*a*. Once parallel, the movable member 33 is slid downward parallel to the lower legs 54*b* of the L-shaped slot until it passes between stops 59*e* and the seat member whereat the moveable member 33 is now positioned in the seat backrest configuration.

Figure 4B:
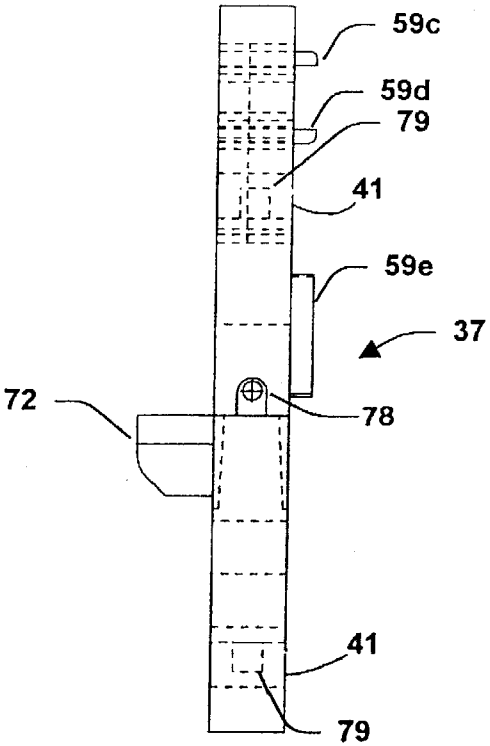
FIG. 4B is a front view of the support member in FIG. 4A.
Figure 4C:
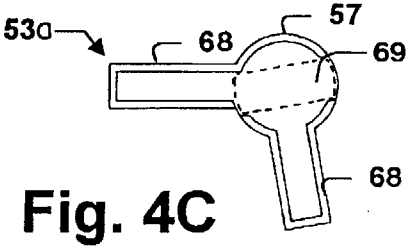
FIG. 4C is an enlarged side view of the L-shaped slot of FIG. 4A.
Figure 4A:
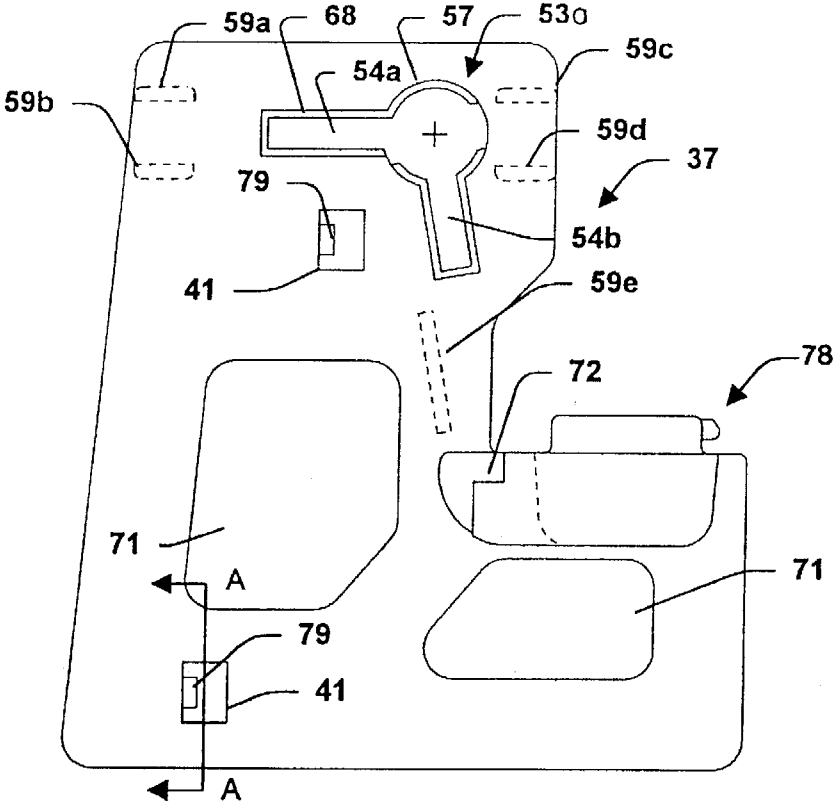
FIG. 4A is a side view of a support member having an L-shaped slot according to the invention.

Referring now to FIGS. 4A–4C, an exemplary embodiment of a support member 37 and its L-shaped slot 53*a* are shown. The support member includes an L-shaped slot 53*a* which affords for slidable positioning of the moveable member 33. The L-shaped slot 53*a* has two legs, an upper leg 54*a* and a lower leg 54*b*, the upper leg 54*a* running substantially parallel to the surface on which the support member 37 rests upon, and the lower leg running in a substantially vertical manner. The L-shaped slot also includes an aperture 57 for allowing rotation of an extension 55 therein, and thus providing for positioning of the moveable member 33 between the seat backrest position and the tabletop position. The L-shaped slot 53*a* further including flange portions 68 disposed along the periphery of the L-shaped slot 53*a*. Flange 68 includes a key hole slot 69 to allow appendages 67 to freely pass through flanges 68 and support member 37. The flange portions 68 in conjunction with the appendages 67 (FIG. 5A) of the moveable member 33 serve to minimize lateral movement of the moveable member 33 and thus facilitating smooth, steady positioning of the member 33.

The support members 37 also include safety stops 59 which serve to secure the moveable member 33 in either the seat backrest position or the tabletop position. The safety stops 59 are preferably arranged as shown in FIGS. 4A & 4B, however, a variety of safety stop(s) 59 arrangements could be employed with the number of stops 59 shown or less or more. The underpinning purpose of the safety stops 59 being to secure the moveable member 33 in a given position. For example, in the positioning of the moveable member from the seat backrest position to the tabletop position, the moveable member 33 is slid upwards along the lower leg 54*b* of the L-shaped slot 53*a* and when the extensions 55 are substantially aligned with the horizontal axis of the respective apertures 57, the moveable member 33 is rotated. When the extensions 55 become aligned with the horizontal axis of the respective apertures 57, the indentations 69 (FIG. 5A) of the moveable member 33 will become aligned with respective safety stops 59*c* and 59*d* and thus allow the moveable member 33 to freely rotate without abutting the safety stops 59*c* and 59*d*.

After the moveable member 33 has traversed the safety stops 59*a*–59*d* (e.g., not abutted the safety stops 59), the member 33 is slid laterally along the upper leg 54*a* of the L-shaped slot 53*a* until it is wedged between the safety stops 59*a*–59*d*. By wedging the moveable member 33 between the safety stops 59, the moveable member 33 is prevented from inadvertently dislodging into the seat backrest position and possibly injuring a user. However, the moveable member 33 may be secured via the safety stops 59 in other manners. For instance, instead of wedging the moveable member 33 between safety stops 59, the member 33 may simply be slid to a point where it resides underneath some safety stops 59 and thus is still prevented from inadvertently dislodging into the seat backrest position.

The support member 37 has cutouts 71 which are not only employed for aesthetic design, they also add to structural rigidity of the support members when made of plastic. Accordingly, any number of cutout shapes could be used to enhance the aesthetic qualities of the bench/table assembly. Additionally, the cutouts 71 serve the useful purpose of decreasing the weight of the assembly and the cost of materials for the assembly while at the same time not taking away from the structural integrity of the support members 37 and the overall assembly 31.

The support member 37 shown in FIG. 4A includes an L-shaped protrusion 72 which serves as a locking foundation for the seat member 35. Additionally, the support members include snoots 78 for lockably securing the seat member 35. Further details regarding the snoots 78 are provided below in the discussion of FIGS. 7A–7C.

Figure 5B:
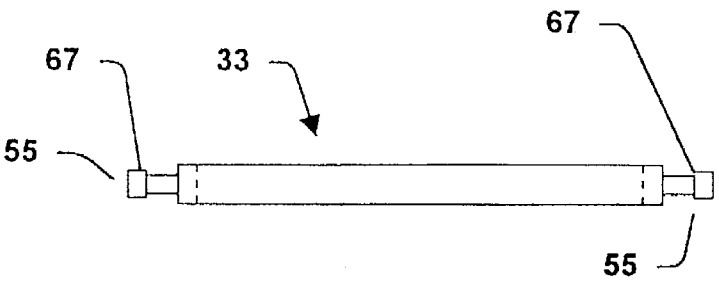
FIG. 5B is a longitudinal side view of the moveable member in FIG. 5A.
Figure 5C:
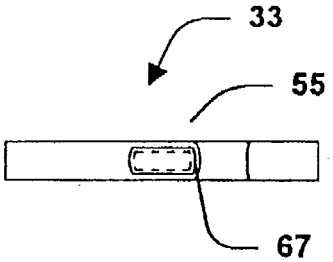
FIG. 5C is a lateral side view of the moveable member in FIG. 5A.
Figure 5A:
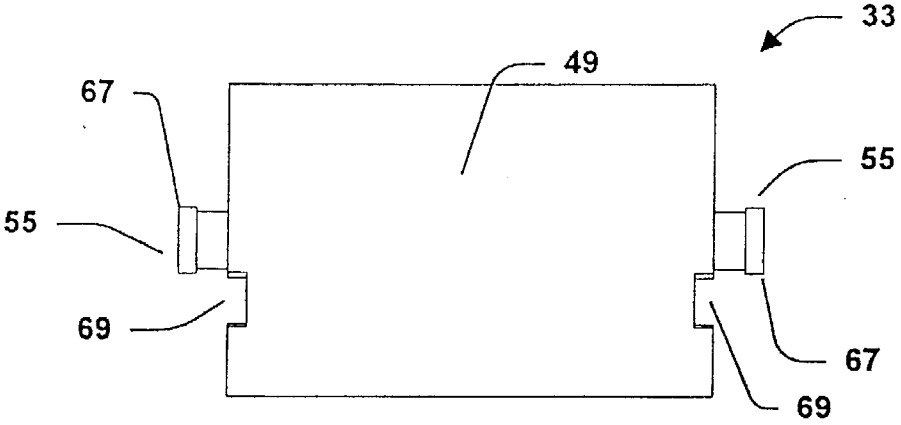
FIG. 5A is a top view of a moveable member according to the invention.

FIGS. 5A, 5B and 5C illustrate the moveable member 33 in greater detail. Initially, with reference to FIGS. 5A–5C, the moveable member 33 is shown with an extension 55 that is shaped in the form of a tab. The extension 55 is slidably engaged within the L-shaped slot 53*a* in the support members 37 to facilitate positioning of the moveable member 33. The tab configuration of the extension 55 provides greater surface area contact with the slot 53*a* than is conventionally available. Accordingly, greater surface area contact equates to increased strength, stability and durability of the bench/table assembly 31. In the tabletop position, a large part of the bottom surface area of the extensions 55 is in contact with the bottom portion of the uppermost leg 54*a* of the respective L-shaped slot 53*a*. As a result, the bench/table assembly 31 can support significantly more weight than conventional assemblies. The extensions 55 may include appendages 67 which serve to restrict lateral sliding of the moveable member 33 and thus providing for greater securement of the moveable member 33 in either the seat backrest position or the tabletop position.

Additionally, the extensions 55 and the inside legs of the L-shaped slot 53*a* may comprise material of substantially low coefficient of friction in order to facilitate easier sliding of the moveable member 33. Such material may include teflon, nylon, paint, enamel or any conventional material suitable for such purpose.

Furthermore, the top 49 and bottom 51 surfaces of the moveable member 33 may serve other functions besides simply being a substantially planar surface. For, example, one side could be a chalk board while the other side could be a game board such as a checker board or chess board. In order to employ a dual purpose moveable member 33, the moveable member must be able to rotate 360°. To accomplish 360° rotation of the moveable member 33, several minor modifications to the basic embodiment need to be made.

Figure 12A:
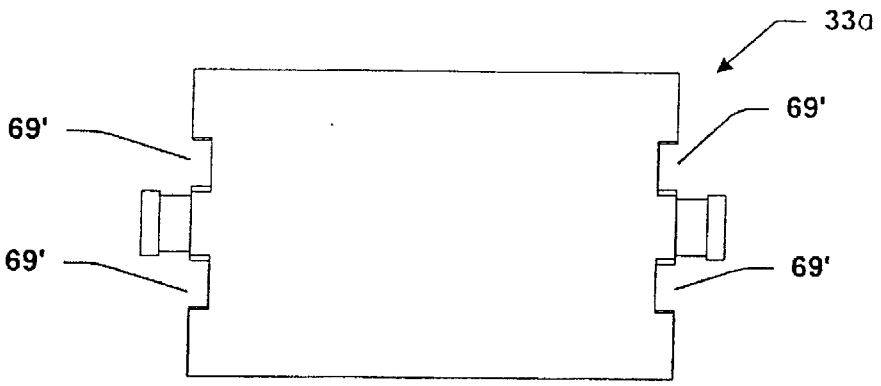
FIG. 12A is a top view of another embodiment of the moveable member according to the invention, wherein there are two sets of indentations.
Figure 13B:
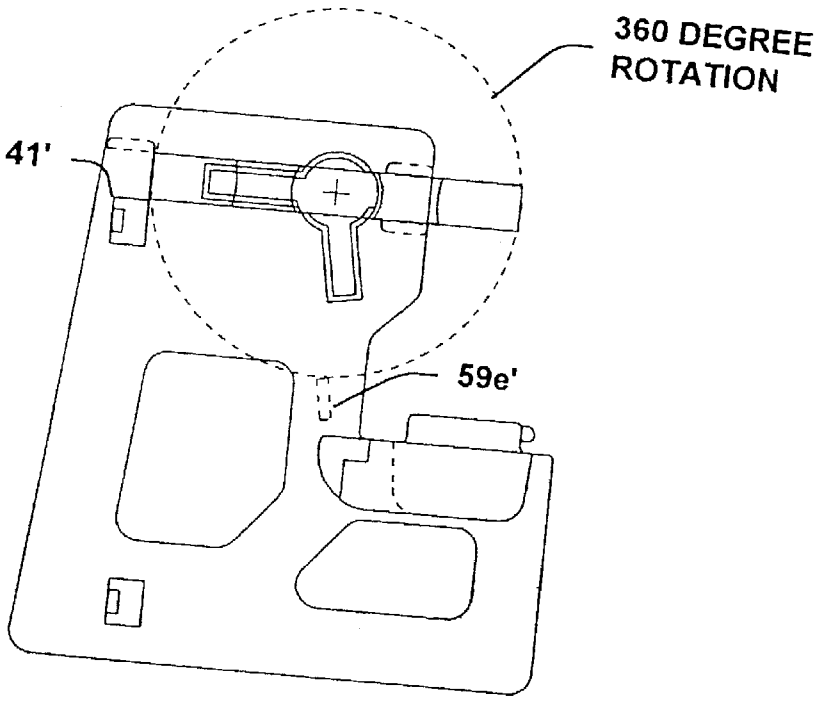
FIGS. 13A and 13B are side views of other embodiments of the support member according to the invention which allow for 360 degree movement of the moveable member.
Figure 13A:
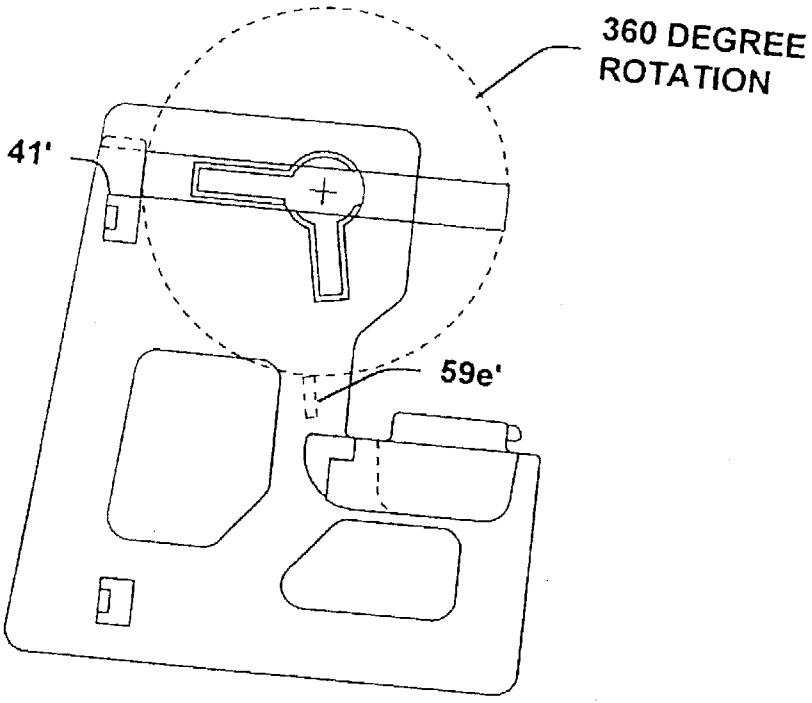

The minor modifications can be to either eliminate the stops 59*c* and 59*d* from the support member 37 (FIG. 13A) or add a second set of indentations 69' to moveable member 33*a* (FIG. 12A). In either case, stop 59*e'* must be shortened and/or positioned lower and the upper slot 41' should be relocated to the former place of stop 59*b*. (FIGS. 13A and 13B).

Figure 12B:
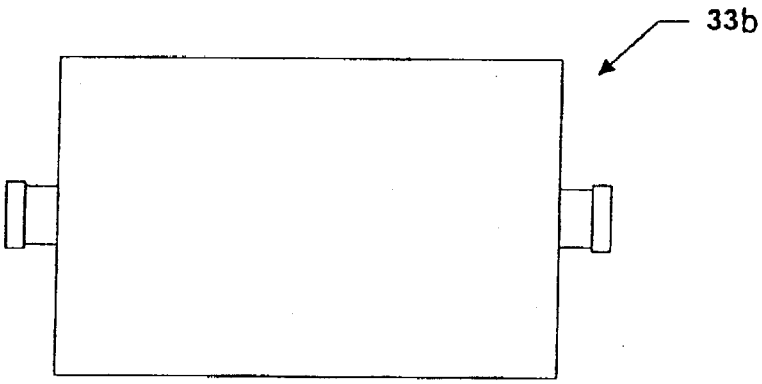
FIG. 12B is a top view of still another embodiment of the moveable member according to the invention, wherein there are no indentations.

If the decision is to eliminate stops 59*c* and 59*d*, the moveable member 33*b* may be made more rectangular (without indentations 69) as shown in FIG. 12B. The benefit of this is a moveable member with greater surface area. If the choice is to keep stops 59*c* and 59*d*, then the moveable member 33*a* must be made with a second set of indentations 69' as shown in FIG. 12A. The benefit is a more stable moveable member in the table top position.

The ability of the moveable member 33 being rotatable 360 degrees at the horizontal axis of the aperture 57 affords for a multi-purpose moveable member 33 wherein a user can employ either the top 49 or the bottom 51 surface depending on the desired use. Of course, numerous surfaces could be employed in the design of the moveable member such as game boards, chalk boards, bulletin boards, card table surface, a decorative surface, etc.

The moveable member 33 includes indentations 69 located on the same sides of the member 33 as the extensions 55. The indentations 69 allow the moveable member 33 to traverse the safety stops 59 (shown in greater detail in FIGS. 4A & 4B) when changing between the seat backrest position and the tabletop position. Without the indentations 69, the moveable member 33 would abut with some of the safety stops 59 during rotation and not be able to achieve the other desired position.

With reference now to FIGS. 6A–6D, a structural brace 39 according to the invention is shown. The brace 39 includes protrusions 75 which are adapted to fit snugly into the slots 41 of the support members 37. The brace protrusions 75 include cavities 77. The cavities 77 are employed for locking engagement with respective wedges 79 located within the slots 41 of the support members. Particularly, the braces 39 serve to connect the support members 37 to form a base structure for the assembly 31. The braces 39 are connected to the respective support members 37 by inserting the protrusions 75 into the slots 41 so that the brace protrusion cavities 77 are aligned for engagement with the respective wedges. The wedges 79 are of a substantially triangular shape so that brace protrusions 75 will easily slide into the respective slots 41. As a respective protrusion 75 travels further inward into a respective slot 41 the fit becomes tighter. After the high point 81 of the respective wedge 79 is traversed by the tip of the protrusion 75, the high point of the wedge 79 will encounter the protrusion cavity 77 where it will snap into place thus securing the brace 39 in a snug and almost permanent fashion. The resiliency of the preferred heavy plastic in the exemplarary embodiment is ideally suited for such connecting of the braces 39 to the slots 41.

Figure 7A:
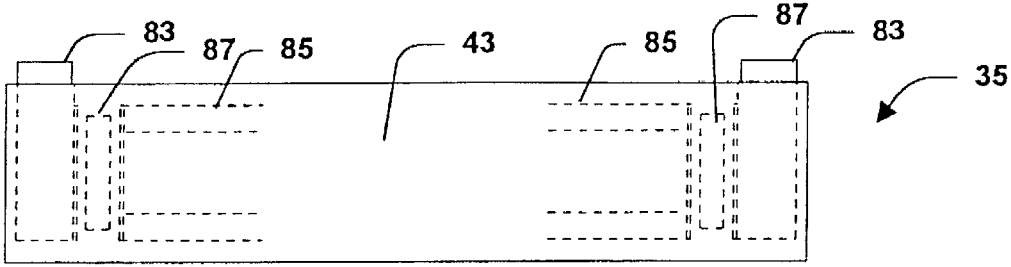
FIG. 7A is a top view of a seat member according to the invention.
Figure 7B:
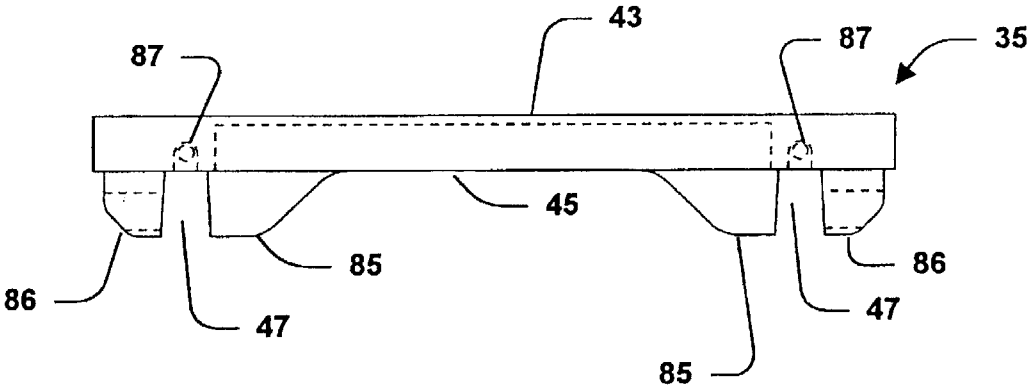
FIG. 7B is a longitudinal side view of the seat member in FIG. 7A.
Figure 7C:
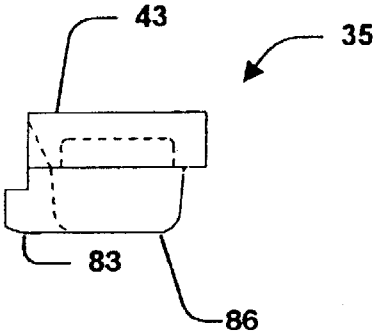
FIG. 7C is a lateral side view of the seat member in FIG. 7A.

Referring now to FIGS. 7A–7C, the seat member 35 is shown in greater detail. The seat member 35 has two reliefs 47 located on the bottom side for engagement with the support members 37. The reliefs 47 are formed by pairs of seat support gussets 85 and 86. The support gussets 85 and 86 serve to displace the vertical forces being applied to the seat member 35 more evenly along the horizontal plane of the seat member. Thus, the support gussets 85 and 86 serve to displace some of the forces being applied at the seat member 35 to support members 37. The other support members 83 (which are extended protrusions of gussets 86) serve to mate with the L-shaped protrusions 72 of the support members 37 so as to secure seat member 35.

The seat member 35 also contains cylindrical cavities 87 which lockably receive snoots 78 (FIGS. 4A and 4B) located on the support members 37. The snoots 78 snap into the cylindrical cavities 87 to secure the seat member 35 onto the support members 37. Of course it is obvious that any variety of conventional snap and lock configurations or other typical securing means could be employed to secure the seat member 35 onto the support members 37.

Figure 8B:
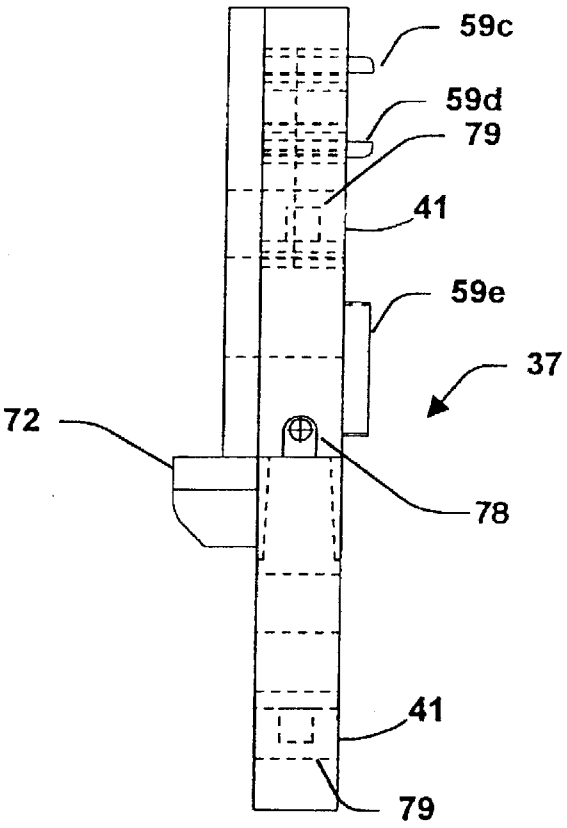
FIG. 8B is a front view of the support member in FIG. 8A.
Figure 8A:
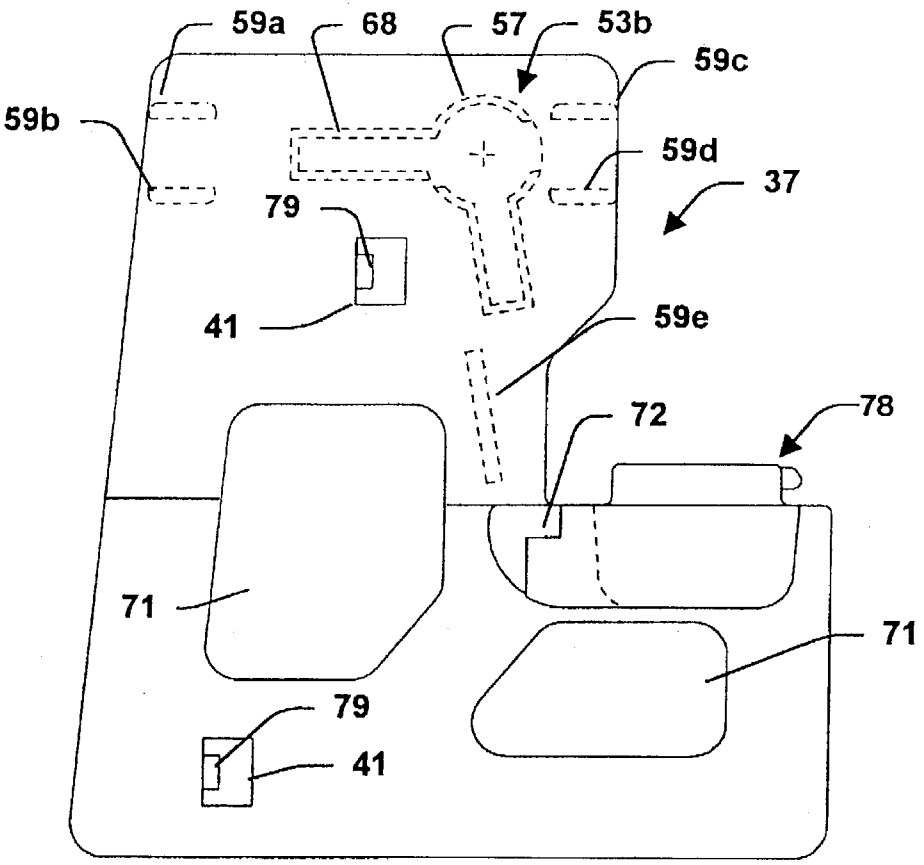
FIG. 8A is a side view of another embodiment of the support member having an internalized L-shaped slot according to the invention.

Referring now to FIGS. 8A and 8B, another embodiment of the support member 37 is depicted wherein the support member 37 is essentially the same as that shown in FIGS. 4A and 4B except that the L-shaped slot **53*b* is internalized. In other words, the L-shaped slot is not cut completely through the support member 37 or material may be added to the upper outer portion of support member 37 as it is in FIGS. 8A & 8B. As a result, this modification of the L-shaped slot 53*b*** may provide greater safety to users and especially to children due to less moveable parts being exposed.

Figure 9B:
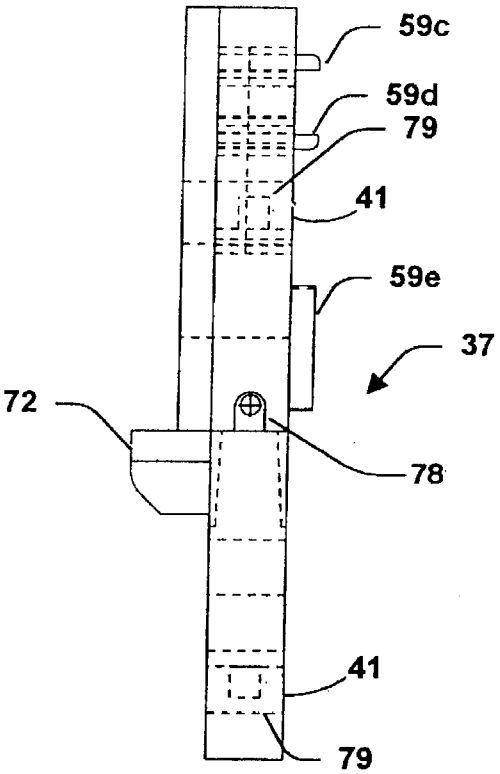
FIG. 9B is a front view of the support member of FIG. 9A.
Figure 9A:
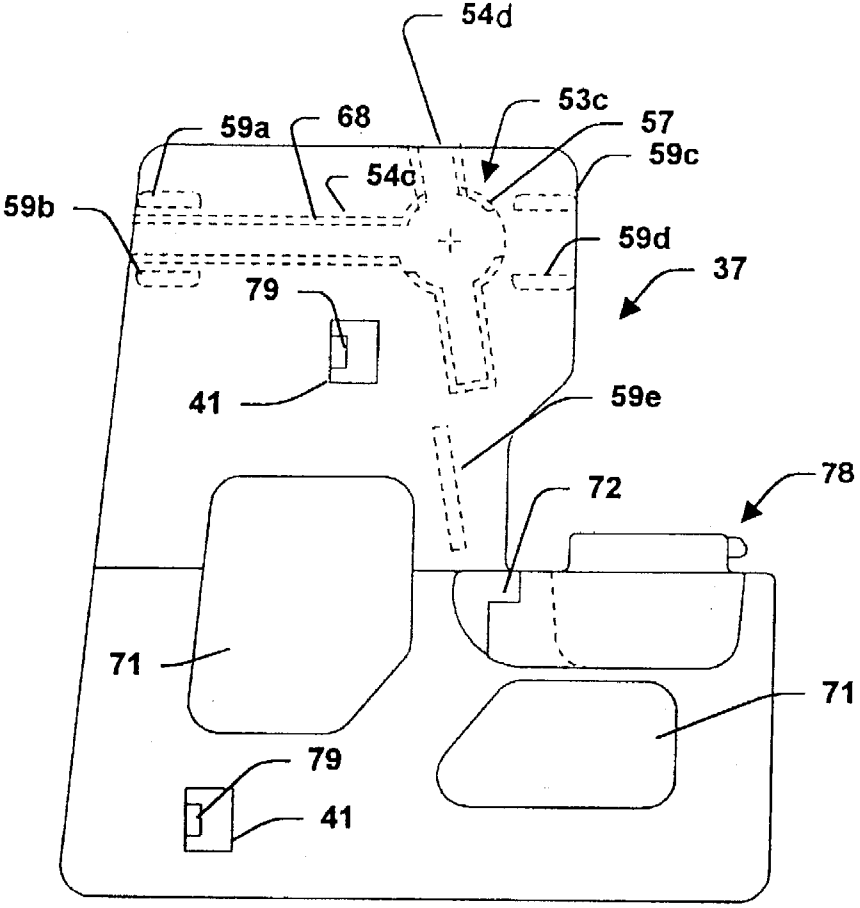
FIG. 9A is a side view of a further embodiment of the support member having an extended L-shaped slot according to the invention.

FIGS. 9A and 9B depict still another embodiment of the support member 37. In this embodiment, the L-shaped slot **53*c* is shown with its legs 54*c* and 54*d* fully extended to the edge of the support member 37. By extending either or both legs of the L-shaped slot 53*c*, a user may easily remove the moveable member 33 so that it may be replaced by another moveable member. However, this will only work when the L-shaped slot is internalized as described above. As discussed earlier, it may be desirable to have a multitude of tabletops available to serve different uses such as for instance different games, drawing boards, chalk boards, dining tops etc. Thus, the extended legs 54*c* and 54*d* afford for such replacement of the moveable member. It is generally preferable to have the lower leg 54*d* (running in the substantially vertical direction) be the extended leg since accidental dislodging of the moveable member 33 is less likely from this leg due to gravity constantly urging the moveable member 33** downward.

Figure 10B:
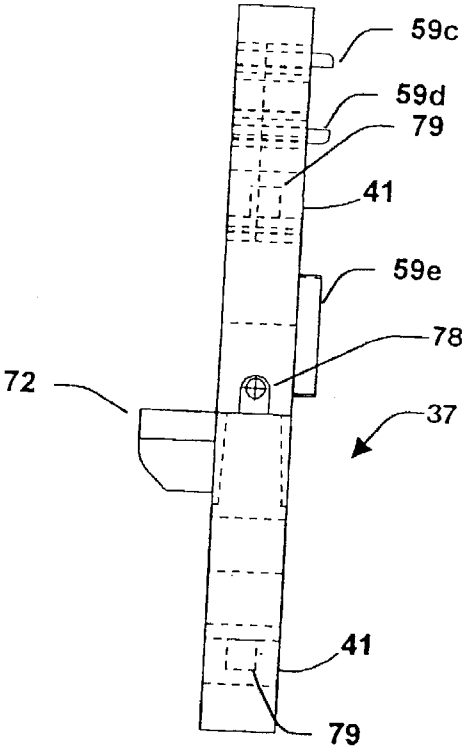
FIG. 10B is a front view of the support member of FIG. 10A.
Figure 10A:
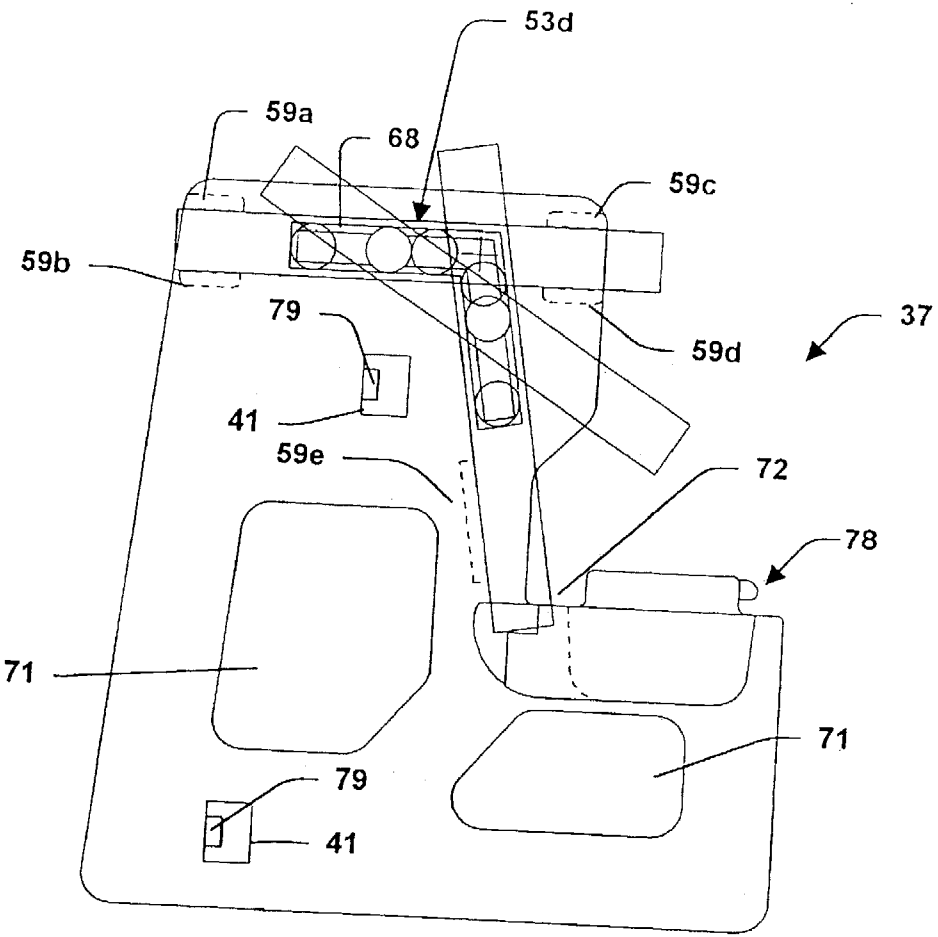
FIG. 10A is a side view of still yet another embodiment of the support member having an L-shaped slot without an aperture at the junction of the two legs of the L-shaped slot.
Figure 11B:
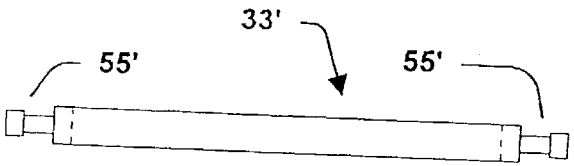
FIG. 11B is a longitudinal side view of the moveable member in FIG. 11A.
Figure 11D:
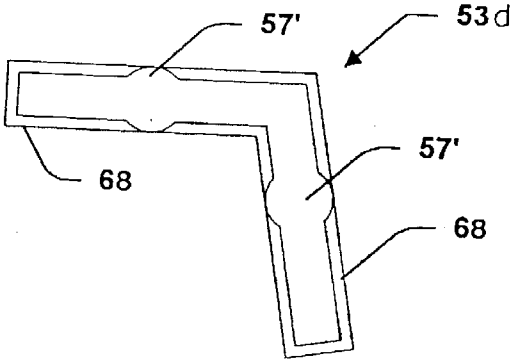
FIG. 11D is a side view of an L-shaped slot adapted for use with the moveable member in FIG. 11A.
Figure 11A:
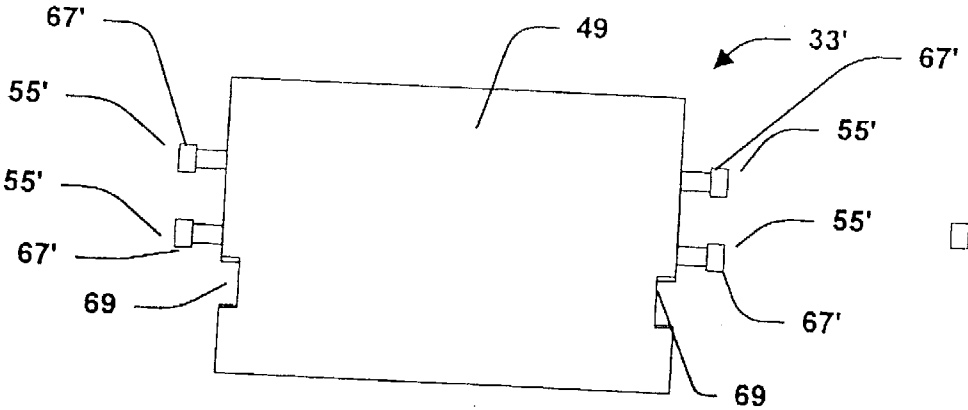
FIG. 11A is a top view of another embodiment of the moveable member according to the invention, wherein the extensions on opposing sides of the moveable member are now pairs of pins.
Figure 11C:
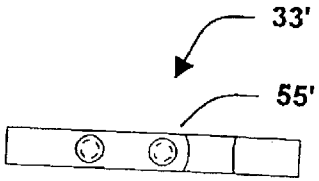
FIG. 11C is a lateral side view of the moveable member in FIG. 11A.

Referring now to FIGS. 10A & 10B, still yet another embodiment of the support member 37 is shown. In this embodiment, the L-shaped slot **53*d* does not have an aperture 57 which affords for 360 degree rotation of the moveable member 33. Rather, the L-shaped slot 53*d* is in the shape of an obtuse angle. This configuration of L-shaped slot 53*d* is adapted for use with the modified moveable member 33' shown in FIGS. 11A–11C. The extensions 55' of the moveable member 33' in FIGS. 11A–11C are a pair of pins rather than the tab configuration depicted in FIGS. 5A–5C. The pins 55' afford for a tighter fit of the moveable member 33' in the L-shaped slots 53*d* than the tab configuration. The pins 55' also include appendages 67' which serve to restrict lateral sliding of the moveable member 33' in the same manner as the appendages 67 do in FIGS. 5A–5C**.

As shown in detail in FIG. 10A, the pins slide parallel along the legs of the L-shaped slots **53*d* thus facilitating movement of the moveable member 33'. For example, the moveable member is shown in three different positions in FIG. 10A. In one position, the moveable member 33' is in the tabletop (i.e., horizontal) position; in another position, the moveable member 33' is shown in the placement position where there are apertures 57' for appendages 67' to pass through flanges 68 and support members 37 (refer to FIG. 11D); in the last position, the moveable member 33' is shown in the seat backrest position. When the junction of the legs of the L-shaped slot is reached, one of the pins 55' will become slidably positioned in the leg other than the one initially traveled upon. This slidable positioning is smoothly accomplished by the spacing between the pair of pins 55' on each respective side of the support member 37. This modification has less play of the moveable member due to no aperture 57, however, the lack of an aperture 57 leads to more limited rotation of the moveable member 33' than if there were an aperture 57. That is 360 degree rotation of the moveable member is not possible without an aperture. The pins 55' of the moveable member 33' may also include wheels (not shown) on their ends to facilitate more smooth sliding within the L-shaped slots 53*d***.

While a particular feature of the invention may have been described above with respect to only one of the illustrated embodiments, such feature may be combined with one or more other features of the other embodiments, as may be desired and advantageous for any given or particular application.

Although the invention has been shown and described with respect to certain preferred embodiments, it is obvious that equivalent alterations and modifications will occur to others skilled in the art upon the reading and understanding of this specification. The present invention includes all such equivalent alterations and modifications.

What is claimed is:

1. A bench/table assembly, comprising:

two support members, each of the two support members including an L-shaped slot, the L-shaped slot having an upper leg and a lower leg;

a seat member spanning the two support members; and a substantially planar moveable member spanning the two support members, the moveable member comprising two extensions, each extension being disposed on opposite sides of the moveable member, each extension adapted to slide substantially within the L-shaped slots, the moveable member being positionable between a first position, exhibiting a seat backrest, and a second position exhibiting a tabletop, the positioning of the moveable member being effectuated by slidable engagement of the extensions with the L-shaped slots.

2. The bench/table assembly of claim 1, wherein the two support members each include at least one safety stop for engagement with the moveable member, the stops serving to prevent dislodging of the moveable member from the second position to the first position.

3. The bench/table assembly of claim 1, wherein the extensions are tabs.

4. The bench/table assembly of claim 1, wherein the extensions are pins.

5. The bench/table assembly of claim 1, wherein the L-shaped slots include horizontal and vertical legs to snugly engage with the corresponding surfaces of the extensions to provide smooth positioning of the moveable member between the first position and the second position and prevent rattling of the moveable member during positioning.

6. The bench/table assembly of claim 5, wherein the horizontal legs are extended to the edge of the support member to afford for replacement of the moveable member.

7. The bench/table assembly of claim 5, where the vertical legs are extended to the edge of the support member to afford for replacement of the moveable member.

8. The bench/table assembly of claim 1, wherein the L-shaped slots each comprise an aperture, the aperture being located substantially at a corner where the upper leg and lower leg of the L-shaped slot meet, wherein the extensions rotate within the respective apertures in order to facilitate positioning of the moveable member.

9. The bench/table assembly of claim 1, wherein the L-shaped slots have an engageable surface of substantially low coefficient of friction to facilitate positioning of the moveable member.

10. The bench/table assembly of claim 9, wherein the engageable surface is comprised of teflon.

11. The bench/table assembly of claim 9, wherein the engageable surface is comprised of nylon.

12. The bench/table assembly of claim 1, wherein the seat member is interlockable with the support members.

13. The bench/table assembly of claim 1, further including at least one support brace spanning the two support members to provide support thereof, wherein the support brace has an interlocking means for interlocking with the support members.

14. The bench/table assembly of claim 13, wherein the interlocking means includes a wedge, the wedge adapted to lockably engage with a cavity of a protrusion of the support brace.

15. The bench/table assembly of claim 1, wherein the moveable member has two sides, each of the sides being usable for a predetermined purpose.

16. A bench/table assembly, comprising:

two support members, each of the two support members including an L-shaped slot, and each of the two support members further including at least one safety stop;

a seat member spanning the two support members;

at least one structural brace spanning the two support members to provide support thereof; and a substantially planar moveable member spanning the two support members, the moveable member comprising two extensions; each extension being disposed on opposite sides of the moveable member, each extension adapted to slide substantially within the L-shaped slots, the moveable member being positionable between a first position, exhibiting a seat backrest, and a second position exhibiting a tabletop, the positioning of the moveable member being effectuated by slidable engagement of the extensions with the L-shaped slots, the moveable member being maintained in the first position by gravity, the moveable member being maintained in the second position by the at least one safety stop which prevents dislodging of the moveable member from the second position to the first position.

17. The bench/table assembly of claim 16, wherein the L-shaped slots each comprise an aperture, the aperture being located substantially at a corner where the upper leg and lower leg of the L-shaped slot meet, wherein the extensions rotate within the respective apertures in order to facilitate positioning of the moveable member.

18. The bench/table assembly of claim 17, wherein the apertures are substantially circular.

19. The bench/table assembly of claim 16, wherein the L-shaped slots include horizontal and vertical portions to snugly engage with the corresponding surfaces of the extensions to provide smooth positioning of the moveable member between the first position and the second position and prevent rattling of the moveable member during positioning.

20. The bench/table assembly of claim 19, wherein the L-shaped slots each comprise an aperture, the apertures affording for rotation of the extensions during positioning of the moveable member.

21. The bench/table assembly of claim 19, wherein the horizontal legs are extended to the edge of the support member to afford for replacement of the moveable member.

22. The bench/table assembly of claim 19, where the vertical legs are extended to the edge of the support member to afford for replacement of the moveable member.

23. The bench/table assembly of claim 16, wherein the seat member is interlockable with the support members.

24. The bench/table assembly of claim 16, wherein the support brace has an interlocking means for interlocking with the support members.

25. The bench/table assembly of claim 24, wherein the interlocking means includes a wedge, the wedge adapted to lockably engage with a cavity of a protrusion of the support brace.

26. The bench/table assembly of claim 16, wherein the moveable member has two sides, each of the sides being usable for a predetermined purpose.

27. A bench/table assembly, comprising:

a seat member;

means for structurally supporting the seat member including at least two support members, wherein each support member has an L-shaped slot and at least one safety stop, the means for structurally supporting the seat member including at least one support brace;

a substantially planar moveable member, the moveable member including two extensions, each extension being disposed on opposite sides of the moveable member, each extension adapted to slide substantially within the L-shaped slots, the moveable member spanning the two support members;

means for positioning the moveable member between a first position, exhibiting a seat backrest, and a second position exhibiting a tabletop, wherein the means for positioning the moveable member includes slidable engagement of the extensions with the L-shaped slots to effectuate the positioning of the moveable member; and means for securing the moveable member in the second position, wherein the means for securing the moveable member in the second position includes using the at least one safety stop to securely wedge the moveable member and prevent the moveable member from dislodging from the second position to the first position.

28. The bench/table assembly of claim 27, wherein the L-shaped slots include horizontal and vertical portions to snugly engage with the corresponding surfaces of the extensions to provide smooth positioning of the moveable member between the first position and the second position and prevent rattling of the moveable member during positioning, each L-shaped slot also including an aperture, the apertures affording for rotation of the extensions during positioning of the moveable member.

29. The bench/table assembly of claim 28, wherein the horizontal legs are extended to the edge of the support member to afford for replacement of the moveable member.

30. The bench/table assembly of claim 28, where the vertical legs are extended to the edge of the support member to afford for replacement of the moveable member.

31. The bench/table assembly of claim 27, wherein the extensions are tabs.

32. The bench/table assembly of claim 27, wherein the extensions are pins.

33. The bench/table assembly of claim 27, wherein the seat member is interlockable with the support members.

34. The bench/table assembly of claim 27, wherein the support brace has an interlocking means for interlocking with the support members.

35. The bench/table assembly of claim 34, wherein the interlocking means includes a wedge, the wedge adapted to lockably engage with a cavity of a protrusion of the support brace.

36. The bench/table assembly of claim 27, wherein the moveable member has two sides, each of the sides being usable for a predetermined purpose.

* * * * *